US010435925B2

(12) United States Patent
Park et al.

(10) Patent No.: US 10,435,925 B2
(45) Date of Patent: Oct. 8, 2019

(54) SLIDING DOOR CONTROLLER UNIT

(71) Applicant: Hyundai Motor Company, Seoul (KR)

(72) Inventors: Jung Hoon Park, Yongin-si (KR); Donggun Jeong, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 278 days.

(21) Appl. No.: 15/372,311

(22) Filed: Dec. 7, 2016

(65) Prior Publication Data

US 2018/0080267 A1 Mar. 22, 2018

(30) Foreign Application Priority Data

Sep. 22, 2016 (KR) ..... 10-2016-0121504

(51) Int. Cl.

| | |
|---|---|
| ***E05B 83/40*** | (2014.01) |
| ***E05B 53/00*** | (2006.01) |
| ***E05B 79/20*** | (2014.01) |
| ***E05B 81/04*** | (2014.01) |
| ***E05B 85/12*** | (2014.01) |
| ***E05C 17/60*** | (2006.01) |

(52) U.S. Cl.

CPC ..... *E05B 83/40* (2013.01); *E05B 53/003* (2013.01); *E05B 79/20* (2013.01); *E05B 81/04* (2013.01); *E05B 85/12* (2013.01); *E05C 17/60* (2013.01)

(58) Field of Classification Search

CPC ..... E05B 83/40; E05B 53/003; E05B 79/20; E05B 81/04; E05B 85/12; E05C 17/60

USPC ..... 292/336.3

See application file for complete search history.

(56) References Cited

U.S. PATENT DOCUMENTS

| | | | | |
|---|---|---|---|---|
| 2001/0005959 | A1* | 7/2001 | Ooe | E05B 81/06 49/280 |
| 2003/0025337 | A1* | 2/2003 | Suzuki | E05B 81/20 292/195 |
| 2005/0099022 | A1* | 5/2005 | Wakatsuki | E05B 81/20 292/336.3 |
| 2007/0273160 | A1* | 11/2007 | Fujimatsu | E05B 81/25 292/216 |
| 2010/0171321 | A1* | 7/2010 | Akizuki | E05B 77/26 292/200 |

FOREIGN PATENT DOCUMENTS

| | | | |
|---|---|---|---|
| CN | 101535584 | A | 9/2009 |
| CN | 104066914 | A | 9/2014 |
| JP | 03-049017 | Y2 | 10/1991 |
| JP | 2016-102324 | A | 6/2016 |
| KR | 10-2005-0007094 | A | 1/2005 |
| KR | 10-2012-0000913 | A | 1/2012 |
| KR | 10-2012-0010015 | A | 2/2012 |

* cited by examiner

*Primary Examiner* — Nathan Cumar
(74) *Attorney, Agent, or Firm* — Morgan, Lewis & Bockius LLP

(57) ABSTRACT

A sliding door controller device may include an inside handle disposed inside a sliding door; a hold open latch release lever disposed to rotate around a hinge, having a first bent portion formed outside the hinge, and disposed to rotate to one side around the hinge by the first bent portion pushed by the inside handle; and an inside handle lever disposed to rotate around the hinge, having a second bent portion formed outside the hinge, and disposed to rotate to the other side around the hinge by the second bent portion pushed by the inside handle.

5 Claims, 4 Drawing Sheets

SLIDING DOOR CONTROLLER UNIT

CROSS-REFERENCE TO RELATED APPLICATION

The present application claims priority to Korean Patent Application No. 10-2016-0121504 filed on Sep. 22, 2016, the entire contents of which is incorporated herein for all purposes by this reference.

BACKGROUND OF THE INVENTION

Field of the Invention

The present invention relates to a sliding door controller device having a structure in which a sliding door is opened or closed and a latch is unlocked.

Description of Related Art

A sliding door installed on the side of a vehicle is a sliding type door in which is opened or closed while sliding in front and rear directions of a vehicle body. Since the door can be opened and closed even in a narrow space and a user easily goes in and out in the sliding door, the sliding door is used in a van type vehicle.

In general, an inner handle disposed inside the vehicle and an outer handle disposed outside the vehicle are mounted on the sliding door. Further, a side latch (alternatively, a front latch) which is a kind of a door closing maintaining means and a lower latch (alternatively, or a door open hold latch) which is a kind of door opening maintaining means are mounted on the sliding door.

In the door closing maintaining means such as the side latch, when the sliding door is in a closed state, the sliding door is fixed to the vehicle body to maintain the sliding door not to be opened. Further, in the door opening maintaining means such as the lower latch, when the sliding door is in an opened state, the sliding door is fixed to the vehicle body to maintain the sliding door to be opened.

The door closing maintaining means and the door opening maintaining means are actuated by operating the inner handle and the outer handle. Accordingly, a remote controller is mounted on the sliding door, which connects the inner handle and the outer handle with the door closing maintaining means and the door opening maintaining means.

In this case, multiple rods and levers are joined to the remote controller, which connect various devices mounted on the sliding door. Further, the multiple rods and levers constitute a complicated link structure in the remote controller.

Accordingly, a lot of time and cost are required for manufacturing the remote controller. Further, the remote controller frequently malfunctions and there are a lot of difficulties even in repairing and checking.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a sliding door controller device having advantages of reducing a weight and the number of components, and facilitating maintenance by deleting the components or modifying a structure and enhancing a degree of design freedom by separating and arranging a portion of an actuator.

Various aspects of the present invention are directed to providing a sliding door controller device including: an inside handle disposed inside a sliding door; a hold open latch release lever disposed to rotate around a hinge, having a first bent portion formed outside the hinge, and disposed to rotate to one side around the hinge by the first bent portion pushed by the inside handle; and an inside handle lever disposed to rotate around the hinge, having a second bent portion formed outside the hinge, and disposed to rotate to the other side around the hinge by the second bent portion pushed by the inside handle.

A cable is pulled by rotating the hold open latch release lever and locking of the hold opening latch is released to move the sliding door.

The cable is pulled by rotating the inside handle lever and locking of a rear latch and a front latch is released to open or close the sliding door.

The sliding door controller device may further include a latch lock release lever disposed to rotate around the hinge, and each of the cables for releasing the locking of the rear latch and the front latch is connected to one end portion of the latch lock release lever and a lock pin which is movable along a guide formed in a longitudinal direction is disposed at the other end portion.

The sliding door controller device may further include a safety lock release actuator disposed to release a safety lock locked while the sliding door is closed by varying a position of the lock pin disposed in the guide.

The sliding door controller device may further include a latch lock release actuator configured to release the locking of the front latch and the rear latch through the cable connected to the latch lock release lever and the hold open latch release lever by pulling one side of the latch lock release lever and one side of the hold open latch release lever through the cable and simultaneously release the locking of the hold open latch.

The latch lock release actuator may be fixedly disposed at the other side of the sliding door through a mounting bracket with a predetermined distance from a handle device in which the inside handle is disposed.

According to an exemplary embodiment of the present invention, a link structure is deleted by directly joining an inside handled and a lever to reduce the number of components, reduce a weight, and facilitate maintenance.

Further, an actuator is separately disposed in a sliding door to enhance a degree of design freedom and facilitate maintenance.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
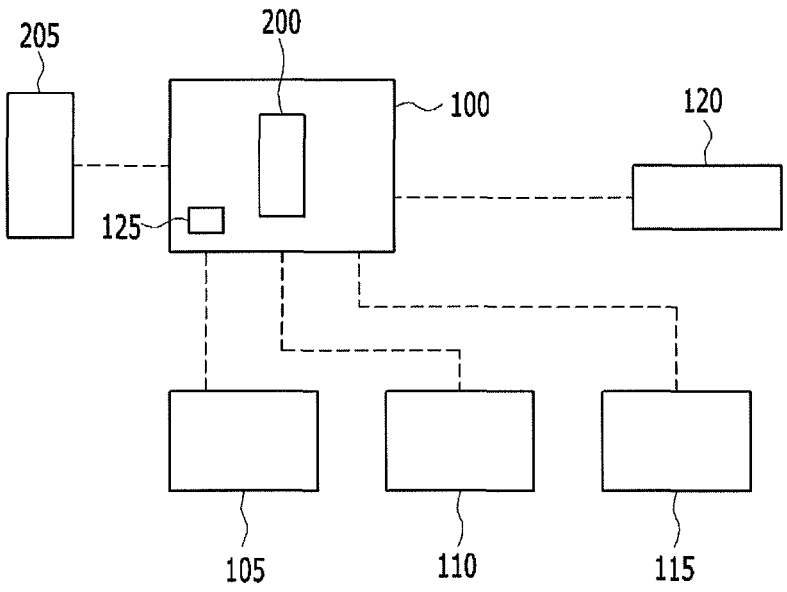
FIG. 1 is a schematic configuration diagram of a sliding door controller device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described in detail with reference to the accompanying drawings.

However, since size and thickness of each component illustrated in the drawings are arbitrarily represented for convenience in explanation, the present invention is not particularly limited to the illustrated size and thickness of each component and the thickness is enlarged and illustrated to clearly express various parts and areas.

However, parts not associated with description are omitted for clearly describing the exemplary embodiment of the present invention and like reference numerals designate like elements throughout the specification.

In the following description, names of components, which are in the same relationship, are divided into "the first", "the second", and the like to distinguish the components, but the present invention is not limited to the order.

FIG. 1 is a schematic configuration diagram of a sliding door controller device according to an exemplary embodiment of the present invention.

Referring to FIG. 1, the controller device includes an outside handle 205, an inside handle 200, a handle device 100, a safety lock release actuator 125, a latch lock release actuator 120, a hold open latch 105, a front latch 110, and a rear latch 115.

The safety lock release actuator 125 and the inside handle 200 are disposed in the handle device 100 and the outside handle 205 is disposed at one side of a sliding door while keeping a distance from the handle device 100. The outside handle 205 and the handle device 100 are connected to each other through a cable.

The safety lock release actuator 125 serves to release a safety lock state. Herein, the safety lock state is performed by a user and in such a state, the sliding door is not opened by the inside handle 200 and the outside handle 205.

The hold open latch 105 fixes the sliding door while a predetermined part of the sliding door is opened, the front latch 110 fixes the sliding door in a closed state in which the sliding door moves forward, and the rear latch 115 fixes the sliding door in a completely opened state in which the sliding door moves backwards.

The latch lock release actuator 120 is connected with the handle 100 through the cable to actuate at least one of levers disposed in the handle device 100, releasing a locking state of the hold open latch 105, the front latch 110, or the rear latch 115.

Figure 2:
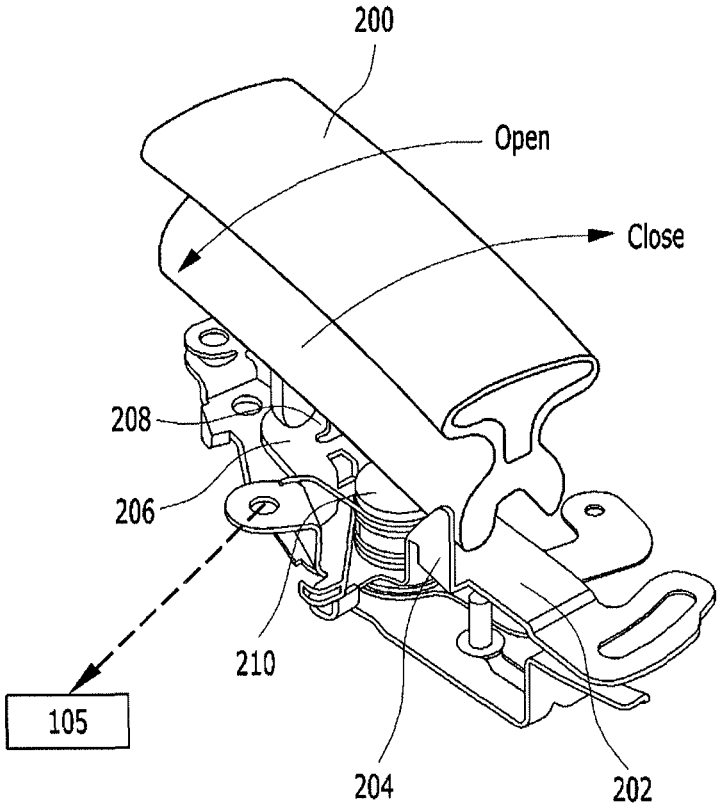
FIG. 2 is a partial perspective view of the sliding door controller device according to the exemplary embodiment of the present invention.

FIG. 2 is a partial perspective view of the sliding door controller device according to the exemplary embodiment of the present invention.

Referring to FIG. 2, the controller device includes a hinge 210, the inside handle 200, a hold open latch release lever 202, an inside handle lever 206, a second bent portion 208, and the hold open latch 105.

The inside handle 200 is disposed inside the door, the hold open latch release lever 202 is disposed to rotate around the hinge 210, and the first bent portion 204 pushed by actuating the inside handle 200 is formed at one side.

When the inside handle 200 is pulled to one side, the first bent portion 204 of the hold open latch release lever 202 is pushed through a rotation movement, and as a result, the hold open latch release lever 202 rotates around the hinge 210 in one direction to pull the cable connected with the hold open latch 105. Accordingly, a hold open lock state in which the sliding is held in the opened state is released.

Further, when the inside handle 200 is pulled to the other side, the second bent portion 208 of the inside handle lever 206 is pushed through the rotation movement, and as a result, the inside handle lever 206 rotates around the hinge 210 in one direction. Therefore, the front latch 110 is released to open the sliding door.

In the exemplary embodiment of the present invention, the inside handle 200 is not connected to the hold open latch release lever 202 and the inside handle lever 206 through a link, but directly connected to the hold open latch release lever 202 and the inside handle lever 206 to reduce the number of components, reduce a weight, reduce manufacturing cost, prevent a malfunction, and enhance an actuation feeling.

Figure 3:
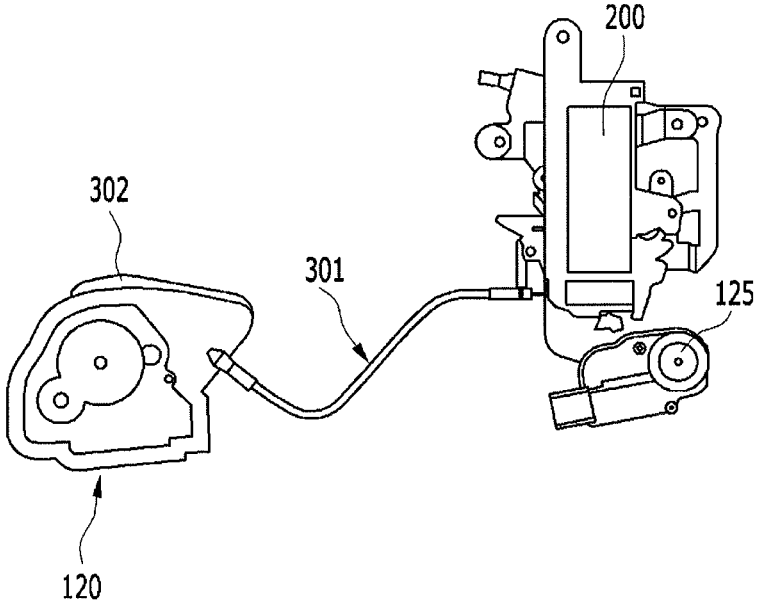
FIG. 3 is a partial schematic configuration diagram of the sliding door controller device according to the exemplary embodiment of the present invention.

FIG. 3 is a partial schematic configuration diagram of the sliding door controller device according to the exemplary embodiment of the present invention.

Referring to FIG. 3, the controller device includes the latch lock release actuator 120, a cable 301, the safety lock release actuator 125, the inside handle 200, and the outside handle 205.

The latch lock release actuator 120 is fixedly disposed at one side of the sliding door by a mounting bracket 302 and releases a lock state through the cable 301 to open the sliding door.

In the exemplary embodiment of the present invention, the latch lock release actuator 120 is disposed separately from the handle device in which the inside handle 200 is disposed to reduce the size of the handle device, enhance a degree of design freedom, anticipate an effect in which maintenance is facilitated.

Figure 4:
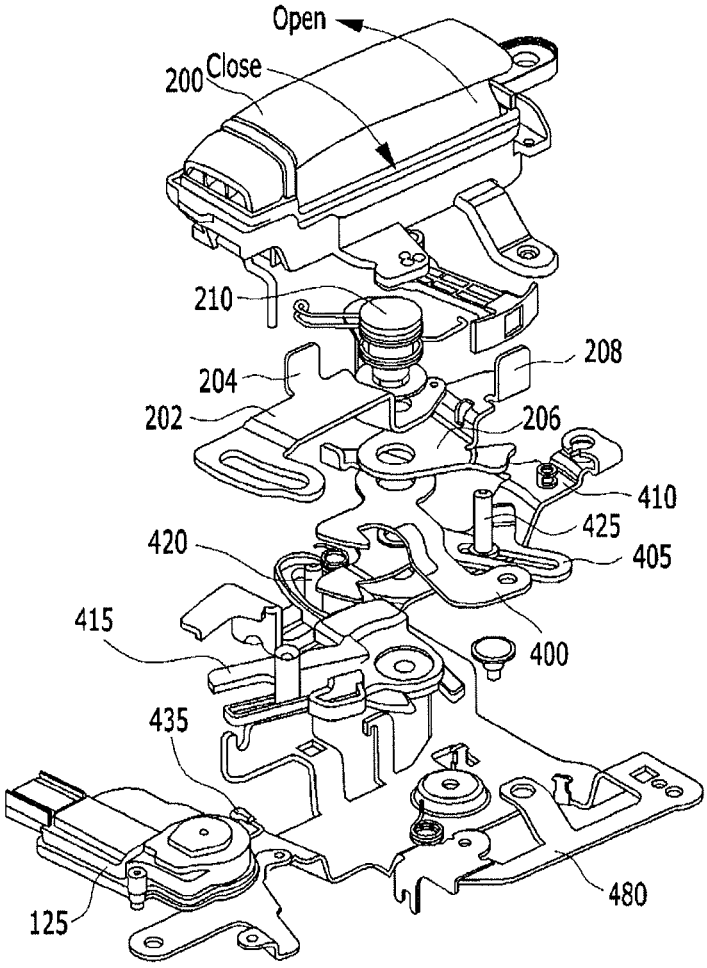
FIG. 4 is a partial exploded perspective view of the sliding door controller device according to the exemplary embodiment of the present invention.

FIG. 4 is a partial exploded perspective view of the sliding door controller device according to the exemplary embodiment of the present invention.

Referring to FIG. 4, the controller device includes the inside handle 200, the second bent portion 208, the inside handle lever 206, a latch lock release lever 410, a child pin 425, a control lever 405, an outside handle lever 400, a base frame 480, the safety lock release actuator 125, an actuator lever 435, a lock lever 415, the hold open latch releaser lever 202, the hinge 210, and the first bent portion 204.

First, by a closing operation of the inside handle 200, when one side of the inside handle 200 pushes the first bent portion 204, the hold open latch release lever 202 rotates around the hinge 210 to release locking of the hold open latch 105 and the hold open latch release lever 202 rotates the latch lock release lever 410 around the hinge through the lock pin 420 to release the locking of the front latch 110 and the rear latch 115, and as a result, the sliding door is closed.

By an opening operation of the inside handle 200, when one side of the inside handle 200 pushes the second bent portion 208, the inside handle lever 206 rotates around the hinge 210 and the controller lever 405 rotates around the hinge 210 through the child pin 425.

Then, the control lever 405 rotates the latch lock release lever 410 around the hinge 210 through the lock pin 420. In addition, the latch lock releaser lever 410 releases the locking of the front latch 110 and the rear latch 115 through the cable to open the sliding door.

The cable rotates the outside handle lever 400 by the opening operation of the outside handle 205 and the latch lock release lever 410 rotates through the lock pin 420, and as a result, the locking of the front latch 110 and the rear latch 115 is released by the cable and a protrusion part of the outside handle lever 400 rotates the hold open latch release lever 202 to release the locking of the hold open latch 105. Accordingly, the sliding door may be opened.

Similarly, the cable rotates the outside handle lever 400 by the closing operation of the outside handle 205 and the latch lock release lever 410 rotates through the lock pin 420, and as a result, the locking of the front latch 110 and the rear latch 115 is released by the cable and the protrusion part of the outside handle lever 400 rotates the hold open latch release lever 202 to release the locking of the hold open latch 105. Accordingly, the sliding door may be closed.

In the exemplary embodiment of the present invention, when a safety lock operation is performed, the lock lever 415 rotates around the hinge 210 and the lock pin 420 thus moves to the outside to prevent the latch lock release lever 410 from being rotated, and as a result, the locking of the front latch 110 and the rear latch 115 is maintained.

In addition, when the safety lock release actuator 125 operates to return the lock lever 415, the lock pin 420 moves inside, and as a result, the latch lock release lever 410 is rotated by the control lever 405 or the outside handle lever 400 to release the locking of the front latch 110 and the rear latch 115.

Further, the child pin 425 has a structure in which the child pin 425 moves along a guide formed on an inside and an outside of the control lever 405 by a switching operation of the user and according to a position thereof, opening of the sliding door by the operation of the inside handle 200 is prevented.

Detailed description of parts not described in the exemplary embodiment of the present invention will be omitted with reference to well-known technology.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A sliding door controller device comprising:

an inside handle disposed inside a sliding door;

a hold open latch release lever disposed to rotate around a hinge, having a first bent portion formed outside the hinge, and disposed to rotate to a first side around the hinge by the first bent portion pushed by the inside handle; and an inside handle lever disposed to rotate around the hinge, having a second bent portion formed outside the hinge, and disposed to rotate to a second side around the hinge by the second bent portion pushed by the inside handle;

a latch lock release lever disposed to rotate around the hinge; and a latch lock release actuator configured to release locking of a front latch and a rear latch through cables connected to the latch lock release lever and the hold open latch release lever by pulling a first side of the latch lock release lever and a first side of the hold open latch release lever through the cables and release the locking of the hold open latch, wherein the latch lock release actuator is fixedly disposed at a second side of the sliding door through a mounting bracket with a predetermined distance from a handle device in which the inside handle is disposed.

2. The sliding door controller device of claim 1, wherein at least a cable of the cables is pulled by rotating the hold open latch release lever and locking of the hold opening latch is released to move the sliding door.

3. The sliding door controller device of claim 2, wherein the at least a cable is pulled by rotating the inside handle lever and locking of the rear latch and the front latch is released to open or close the sliding door.

4. The sliding door controller device of claim 1, wherein the at least a cable includes a plurality of cables including the cables, each of the cables for releasing the locking of the rear latch and the front latch is connected to a first end portion of the latch lock release lever and a lock pin which is movable along a guide formed in a longitudinal direction thereof is disposed at a second end portion thereof.

5. The sliding door controller device of claim 4, further including:

a safety lock release actuator disposed to release a safety lock locked while the sliding door is configured to be closed by varying a position of the lock pin disposed in the guide.

* * * * *